US010539019B2

(12) United States Patent
Havakeshian et al.

(10) Patent No.: US 10,539,019 B2
(45) Date of Patent: Jan. 21, 2020

(54) STATIONARY BLADES FOR A STEAM TURBINE AND METHOD OF ASSEMBLING SAME

(71) Applicant: General Electric Technology GmbH, Baden (CH)

(72) Inventors: Saeid Havakeshian, Baden (CH); Krzysztof Cherek, Wetingen (CH)

(73) Assignee: General Electric Company, Schenectady, NY (US)

( * ) Notice: Subject to any disclaimer, the term of this patent is extended or adjusted under 35 U.S.C. 154(b) by 70 days.

(21) Appl. No.: 15/671,562

(22) Filed: Aug. 8, 2017

(65) Prior Publication Data

US 2018/0045053 A1 Feb. 15, 2018

(30) Foreign Application Priority Data

Aug. 12, 2016 (EP) ..... 16184125

(51) Int. Cl.
*F01D 5/18* (2006.01)
*F01D 1/20* (2006.01)
(Continued)

(52) U.S. Cl.
CPC ..... *F01D 1/20* (2013.01); *F01D 5/28* (2013.01); *F01D 9/041* (2013.01); *F01D 25/10* (2013.01); *F01D 25/24* (2013.01); *F01D 5/141* (2013.01); *F01D 5/146* (2013.01); *F01D 5/147* (2013.01); *F01D 5/186* (2013.01); *F05D 2220/31* (2013.01); *F05D 2230/50* (2013.01); *F05D 2240/122* (2013.01); *F05D 2240/304* (2013.01); *F05D 2240/305* (2013.01);
(Continued)

(58) Field of Classification Search
CPC ..... F01D 5/186; F01D 5/147; F01D 5/141; F01D 5/146; F04D 29/388; F04D 29/384
See application file for complete search history.

(56) References Cited

U.S. PATENT DOCUMENTS 5,503,529 A 4/1996 Anselmi et al.
6,224,339 B1 * 5/2001 Rhodes ..... F01D 5/186 416/224
(Continued)

FOREIGN PATENT DOCUMENTS

DE 196 40 298 A1 4/1998
EP 2 743 451 A1 6/2014
(Continued)

OTHER PUBLICATIONS

Extended European Search Report and Opinion issued in connection with corresponding EP Application No. 16184125.9 dated Feb. 14, 2017.

*Primary Examiner* — Justin D Seabe
*Assistant Examiner* — Behnoush Haghighian
(74) *Attorney, Agent, or Firm* — Frank A. Landgraff; Charlotte C. Wilson; James W. Pemrick

(57) ABSTRACT

A set of stationary blades for a steam turbine is provided. At least one of the stationary blades includes a suction side and an opposite pressure side, and a plurality of ejection channels defined in the at least one stationary blade. Each of the plurality of ejection channels extends through an outer surface of the pressure side, and each of the plurality of ejection channels is coupled in flow communication to a blade inlet aperture.

17 Claims, 9 Drawing Sheets

(51) Int. Cl.

| | |
|---|---|
| ***F01D 25/24*** | (2006.01) |
| ***F01D 5/28*** | (2006.01) |
| ***F01D 9/04*** | (2006.01) |
| ***F01D 25/10*** | (2006.01) |
| *F01D 5/14* | (2006.01) |

(52) U.S. Cl.
CPC ..... *F05D 2240/306* (2013.01); *F05D 2260/2322* (2013.01); *F05D 2270/16* (2013.01)

(56) References Cited

U.S. PATENT DOCUMENTS 6,272,861 B1 * 8/2001 Bergmann ..... F01D 25/08 415/115
7,153,096 B2 * 12/2006 Thompson ..... F01D 5/147 415/200
7,198,458 B2 * 4/2007 Thompson ..... F01D 5/147 415/115
7,247,003 B2 * 7/2007 Burke ..... F01D 5/147 416/229 A
7,255,535 B2 * 8/2007 Albrecht ..... F01D 5/147 416/229 R
7,422,415 B2 9/2008 Burdgick et al.
8,033,790 B2 * 10/2011 Vance ..... F01D 5/147 416/213 R
8,167,537 B1 * 5/2012 Plank ..... F01D 5/147 415/115
8,251,651 B2 * 8/2012 Propheter-Hinckley ..... F01D 5/284 415/200
8,322,988 B1 * 12/2012 Downs ..... F01D 5/147 416/96 A
8,568,090 B2 10/2013 Guo et al.
8,714,915 B2 5/2014 Blatchford et al.
9,689,265 B2 * 6/2017 de Diego ..... F01D 5/282
10,107,119 B2 * 10/2018 Walston ..... F01D 9/041

FOREIGN PATENT DOCUMENTS

JP H11-350905 A 12/1999
JP 2013-060931 A 4/2013
JP 2013-185494 A 9/2013

* cited by examiner

STATIONARY BLADES FOR A STEAM TURBINE AND METHOD OF ASSEMBLING SAME

BACKGROUND

The field of the disclosure relates generally to stationary blades for steam turbines, and, more particularly, to stationary blades that provide steam ejection.

At least some known steam turbines include rotor blades that are susceptible to erosion, which reduces an operational efficiency and lifetime of the blades. In at least some known steam turbines, the erosion at least partially results from deposition of fine water droplets on a pressure side of a stationary blade upstream of the rotor blade. For example, but not by way of limitation, the fine water droplets may form a water film on the pressure side of the stationary blade. The water film may release from the trailing edge of the stationary blade and form coarse water droplets that impinge on downstream rotor blades, causing erosion. At least some such known steam turbines include water extraction from the flow path to reduce water droplet deposition on the stationary blades. However, water extraction typically increases a manufacturing cost of, and reduces an operating efficiency of, the steam turbine. Additionally or alternatively, passive approaches to reducing such erosion through changes to the last stage guide vanes, runner blades, and flow path design parameters typically leads to a performance reduction and/or higher blading costs.

BRIEF DESCRIPTION

In one aspect, a set of stationary blades for a steam turbine is provided. At least one of the stationary blades includes a suction side and an opposite pressure side, and a plurality of ejection channels defined in the at least one stationary blade. Each of the plurality of ejection channels extends through an outer surface of the pressure side and is coupled in flow communication to a blade inlet aperture.

In another aspect, a steam turbine is provided. The steam turbine includes a casing that includes a supply passage defined therein. The supply passage is configured to receive an ejection fluid. The steam turbine also includes an outer ring coupled to the casing. The outer ring includes at least one outer ring inlet aperture defined therein and in flow communication with the supply passage. The steam turbine further includes a set of stationary blades coupled to the outer ring and extending radially inward therefrom. At least one of the stationary blades includes a suction side, an opposite pressure side, and a plurality of ejection channels defined in the at least one stationary blade. Each of the plurality of ejection channels extends through an outer surface of the pressure side and is coupled in flow communication to the at least one outer ring inlet aperture.

In another aspect, a method of making a set of stationary blades for a steam turbine is provided. The set of stationary blades is coupled to an outer ring and extends radially inward therefrom. The method includes forming a suction side and an opposite pressure side of at least one of the stationary blades, and forming a plurality of ejection channels within the at least one stationary blade. Each of the ejection channels extends through an outer surface of the pressure side and is coupled in flow communication to a blade inlet aperture of the at least one stationary blade.

DETAILED DESCRIPTION

The embodiments described herein provide a stationary blade that includes a plurality of ejection channels configured to eject a fluid at a temperature higher than a temperature of a working steam proximate the stationary blade. The higher temperature of the ejected fluid tends to evaporate water droplets in the working steam proximate the outer surface of the stationary blade, thereby reducing a deposition of water film on the stationary blade, which in turn reduces a release of coarse water droplets from a trailing edge of the stationary blade, thereby reducing erosion caused by impingement of such droplets on downstream rotor blades. In some embodiments, the ejection channels are oriented to eject the fluid along a pressure side of the stationary blade towards the trailing edge, which tends to energize any remaining droplets in a direction that further reduces a deposition of water film on the stationary blade, again reducing a release of coarse water droplets from the trailing edge of the stationary blade and, thus, further reducing erosion caused by impingement of such droplets on downstream rotor blades. In certain embodiments in which the stationary blades are embodied as a diaphragm, a circumferential section of an inner ring of the diaphragm and corresponding inner portions of the stationary blades extending radially outward therefrom are formed together unitarily, and outer portions of the stationary blades, which include the ejection channels, are formed separately and coupled to the inner portions.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," is not to be limited to the precise value specified. In at least some instances, the approximating language may correspond to the precision of an instrument for measuring the value. Here and throughout the specification and claims, range limitations are identified. Such ranges may be combined and/or interchanged, and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
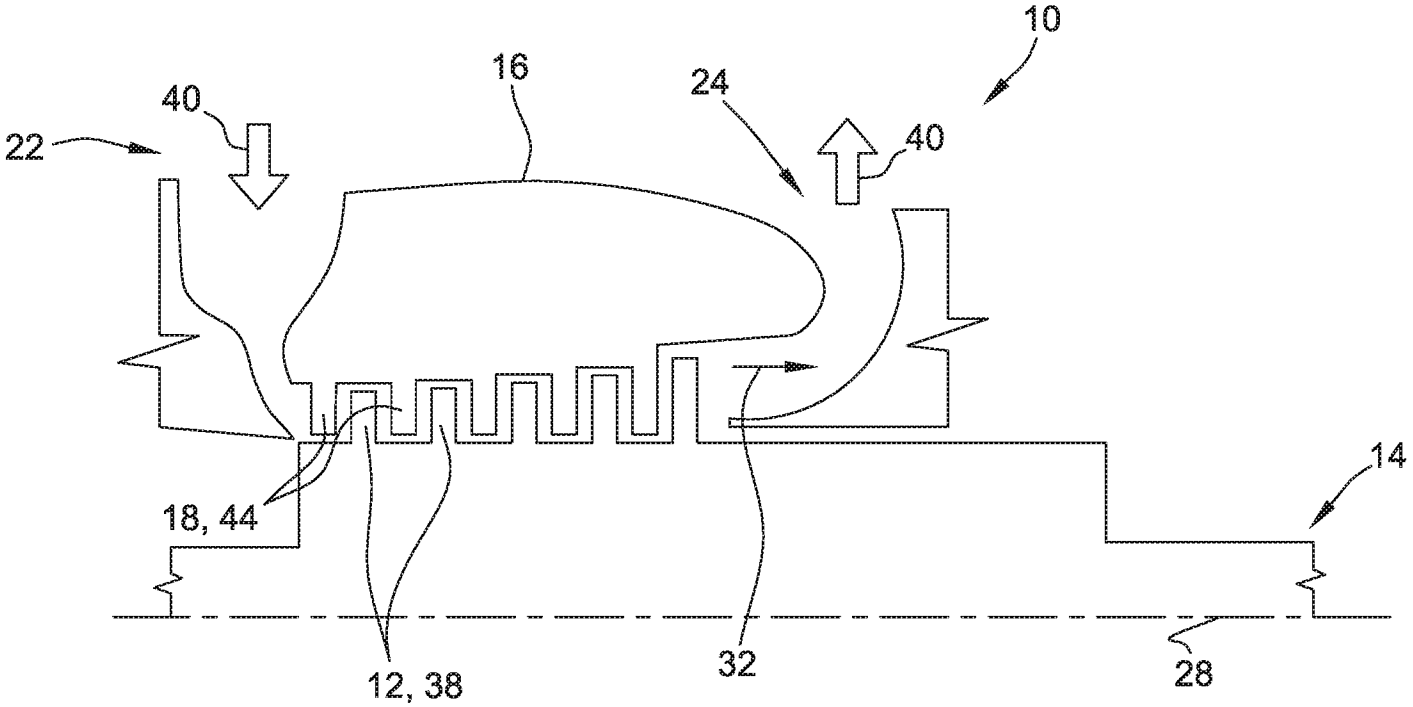
FIG. 1 is a schematic view of an exemplary steam turbine.

FIG. 1 is a schematic view of an exemplary steam turbine 10. In the exemplary embodiment, steam turbine 10 is a single-axial-flow steam turbine. In alternative embodiments, steam turbine 10 has any suitable configuration, for example, an opposed-axial-flow steam turbine.

In the exemplary embodiment, steam turbine 10 includes a plurality of turbine stages 12. Although five turbine stages 12 are illustrated, it should be understood that steam turbine 10 includes any suitable number of stages. Each turbine stage 12 includes a plurality of circumferentially disposed rotor blades 38 coupled to a rotor 14. It should be noted that, as used herein, the term "couple" is not limited to a direct mechanical, electrical, and/or communication connection between components, but may also include an indirect mechanical, electrical, and/or communication connection between multiple components. Rotor blades 38 extend radially outward from rotor 14. Each turbine stage 12 includes any suitable number of rotor blades 38 that enables steam turbine 10 to operate as described herein.

A casing 16 surrounds plurality of turbine stages 12. A plurality of sets 18 of stationary blades are statically coupled to casing 16, such that a respective set 18 of stationary blades is positioned upstream of each turbine stage 12. Each set 18 of stationary blades includes a plurality of circumferentially disposed stationary blades 44 configured to direct working steam 40 in a primary flow path 32 into the succeeding turbine stage 12. Stationary blades 44 are generally airfoil shaped and extend radially inward from casing 16. Each set 18 of stationary blades includes any suitable number of stationary blades 44 that enables steam turbine 10 to operate as described herein.

Steam turbine 10 includes a higher pressure steam inlet 22 and a lower pressure steam exhaust 24. Rotor 14 is rotatable about a centerline axis 28. During operation, working steam 40 is channeled from a working steam source, such as a boiler or the like (not shown), through steam inlet 22 and downstream through casing 16 along primary flow path 32, where working steam 40 encounters stationary blades 44 and rotor blades 38. As the steam impacts rotor blades 38, it induces rotation of rotor 14 about centerline axis 28. Thus, thermal energy of working steam 40 is converted to mechanical rotational energy by turbine stages 12. Working steam 40 exits casing 16 at steam exhaust 24. Working steam 40 is then channeled, for example, to the boiler (not shown), where it is reheated, and/or to other components of the system, for example, a low pressure turbine section or a condenser (not shown).

Figure 2:
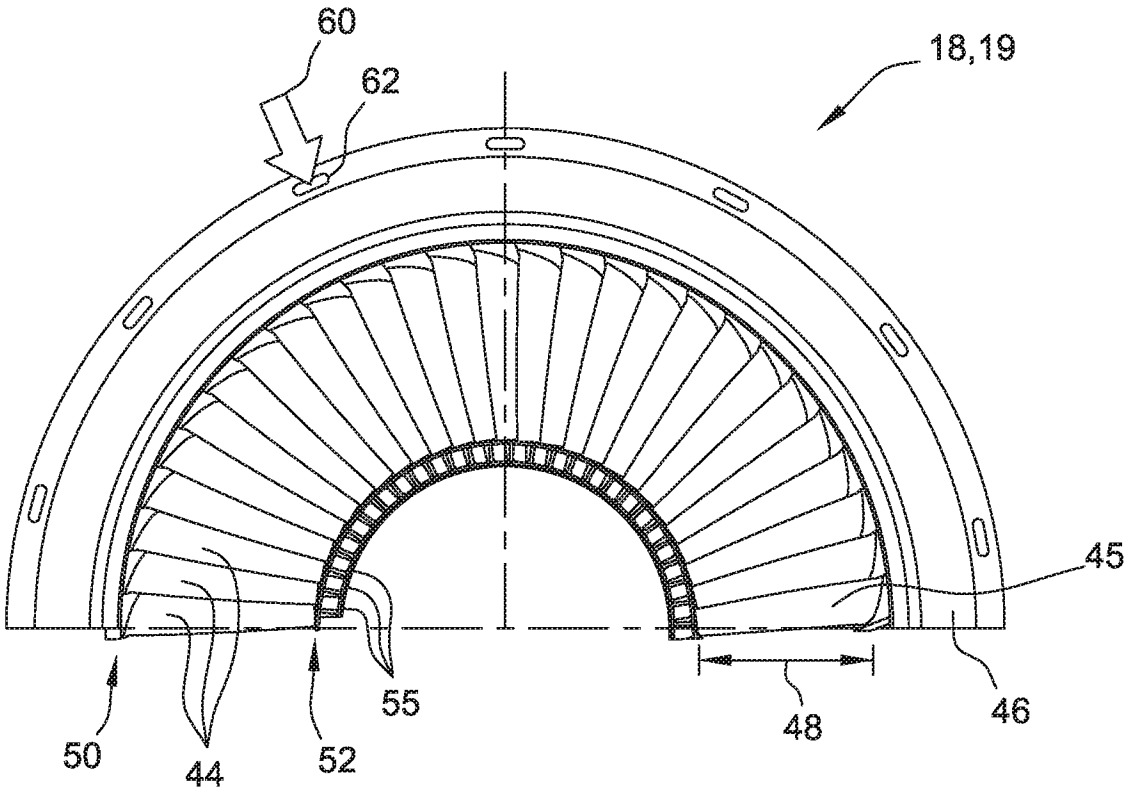
FIG. 2 is a schematic perspective view of an exemplary embodiment of a set of stationary blades for use with the exemplary steam turbine shown in FIG. 1, wherein the stationary blades are provided as single blades coupled to a vane carrier.

FIG. 2 is a schematic perspective view of an exemplary embodiment of one of the sets 18 of stationary blades, wherein the stationary blades 44 are provided as a plurality of single blades coupled to a vane carrier 19. More specifically, FIG. 2 illustrates a half-circumferential section of vane carrier 19. In addition to stationary blades 44, vane carrier 19 includes an outer ring 46 configured for static coupling to casing 16. For example, outer ring 46 includes a plurality of slots (not numbered) each configured to slidingly receive one of stationary blades 44. Further in the exemplary embodiment, each stationary single blade 44 includes an inner platform 55 proximate second end 52 and configured for coupling against inner platform 55 of adjacent stationary single blades 44. In alternative embodiments, each stationary single blade 44 includes any suitable structure proximate second end 52. Although vane carrier 19 is illustrated in a half-circumferential section, it should be understood that in alternative embodiments, vane carrier 19 is formed from any suitable number of circumferentially extending sections coupled together, and statically coupled to casing 16.

Figure 3:
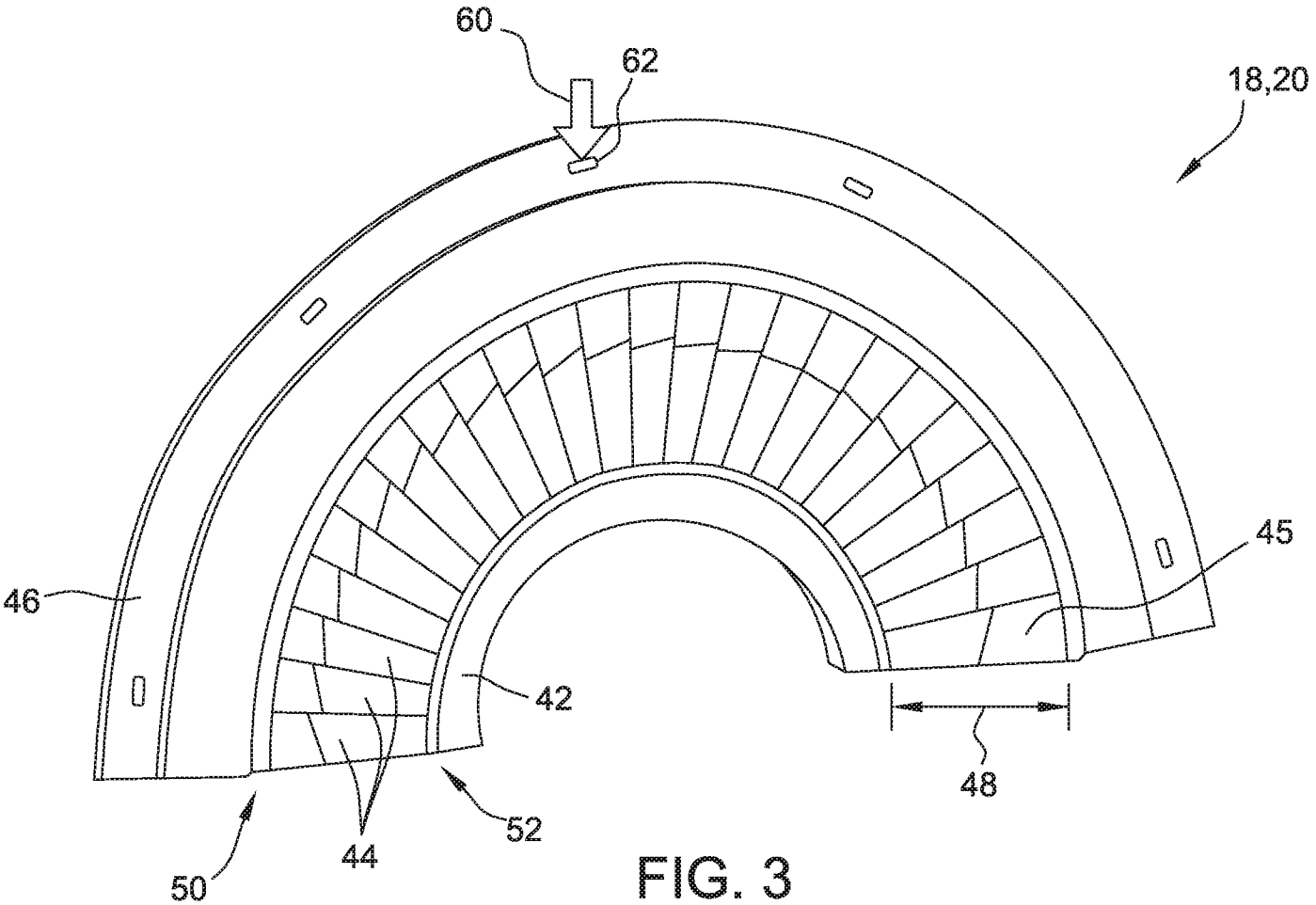
FIG. 3 is a schematic perspective view of another exemplary embodiment of a set of stationary blades for use with the exemplary steam turbine shown in FIG. 1, wherein the stationary blades are provided as a diaphragm.

FIG. 3 is a schematic perspective view of another exemplary embodiment of one of the sets 18 of stationary blades, wherein the stationary blades 44 are provided as a diaphragm 20. More specifically, FIG. 3 illustrates a half-circumferential section of diaphragm 20. In addition to stationary blades 44, diaphragm 20 includes a radially outer ring 46 configured for static coupling to casing 16, and also a radially inner ring 42 configured for positioning adjacent rotor 14. Although diaphragm 20 is illustrated in a half-circumferential section, it should be understood that in alternative embodiments, diaphragm 20 is formed from any suitable number of circumferentially extending sections coupled together, and statically coupled to casing 16.

Referring to FIGS. 2 and 3, in the exemplary embodiment, each stationary blade 44 includes an airfoil portion 45 that extends from a first end 50 radially inward to an opposite second end 52. First end 50 is coupled to outer ring 46 in any suitable fashion, and second end 52 is coupled to inner ring 42 in any suitable fashion. A span 48 of each stationary diaphragm blade 44 is defined between first end 50 and second end 52.

Further in the exemplary embodiment, outer ring 46 includes at least one outer ring inlet aperture 62 defined therein and configured to receive an ejection fluid 60, such as steam, from an ejection fluid source via a suitable supply passage (not shown) in casing 16. In the exemplary embodiment, when steam turbine 10 is in operation, ejection fluid 60 is at a higher temperature and pressure than working steam 40 in primary flow path 32 proximate the set 18 of stationary blades 44. For example, ejection steam 60 is supplied from an upstream location in steam turbine 10. For another example, ejection steam 60 is supplied directly from the same source that supplies working steam 40, albeit with no prior expansion in upstream turbine stages 12. Alternatively, ejection fluid 60 is supplied from any suitable fluid source that enables the sets 18 of stationary blades to function as described herein.

Figure 4:
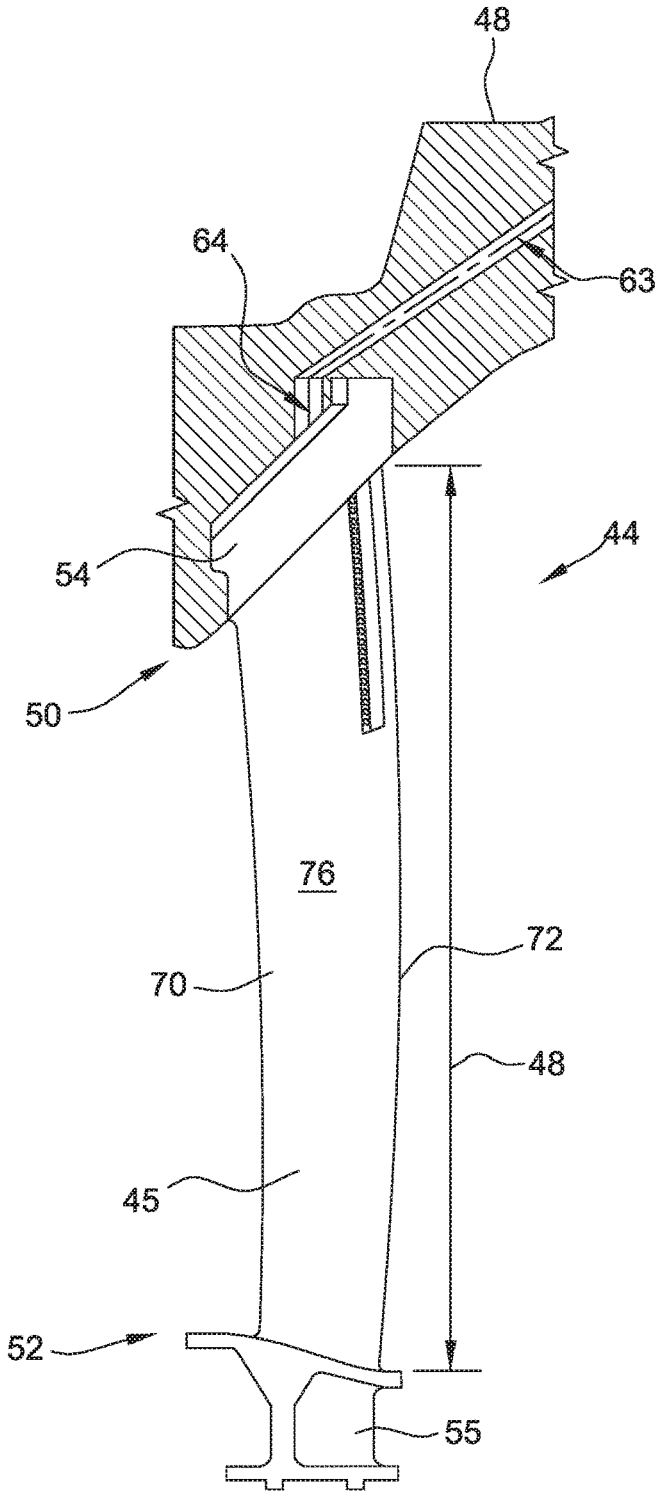
FIG. 4 is a schematic perspective view of an exemplary embodiment of a stationary blade for use with the exemplary plurality of stationary single blades shown in FIG. 2.
Figure 5:
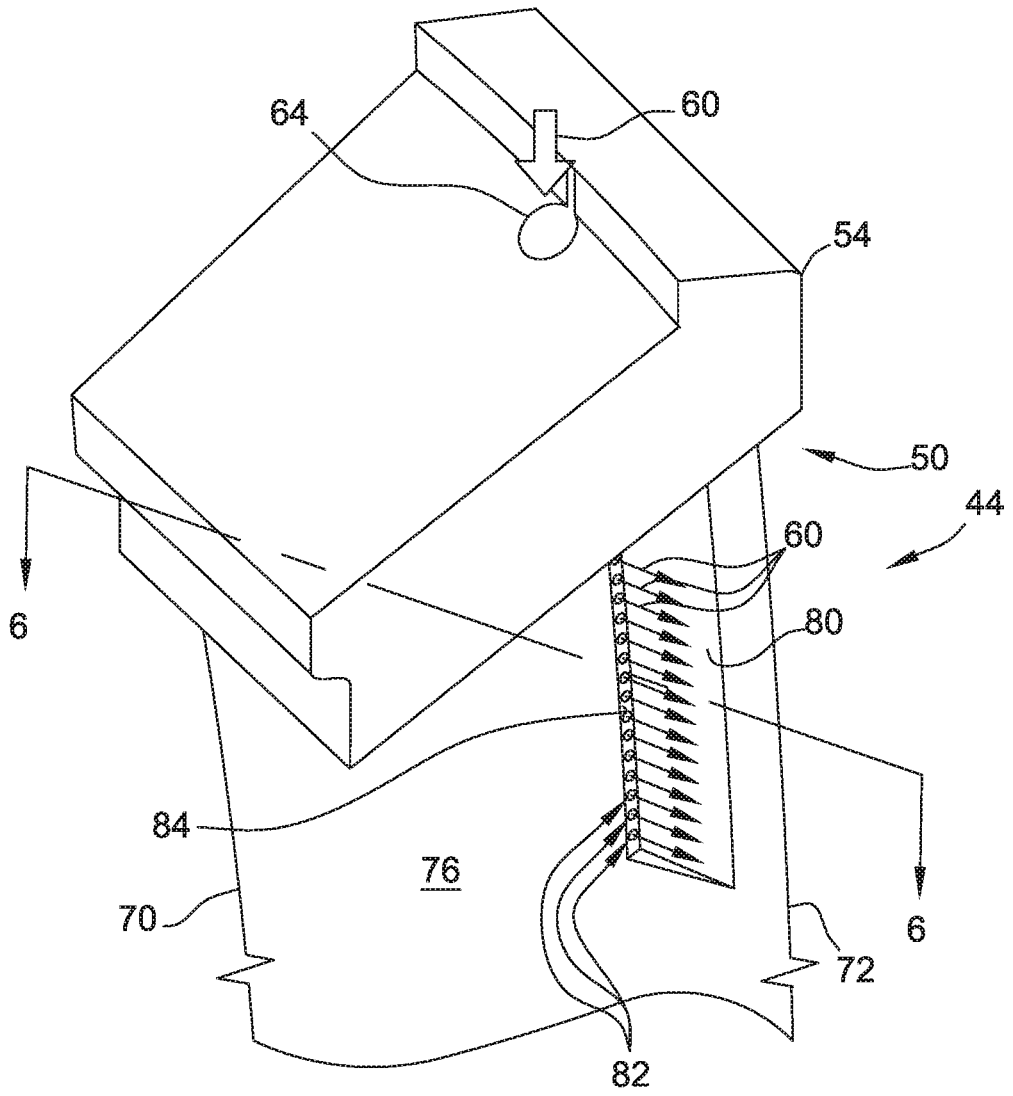
FIG. 5 is another schematic perspective view of portion of the exemplary stationary blade shown in FIG. 4.
Figure 6:
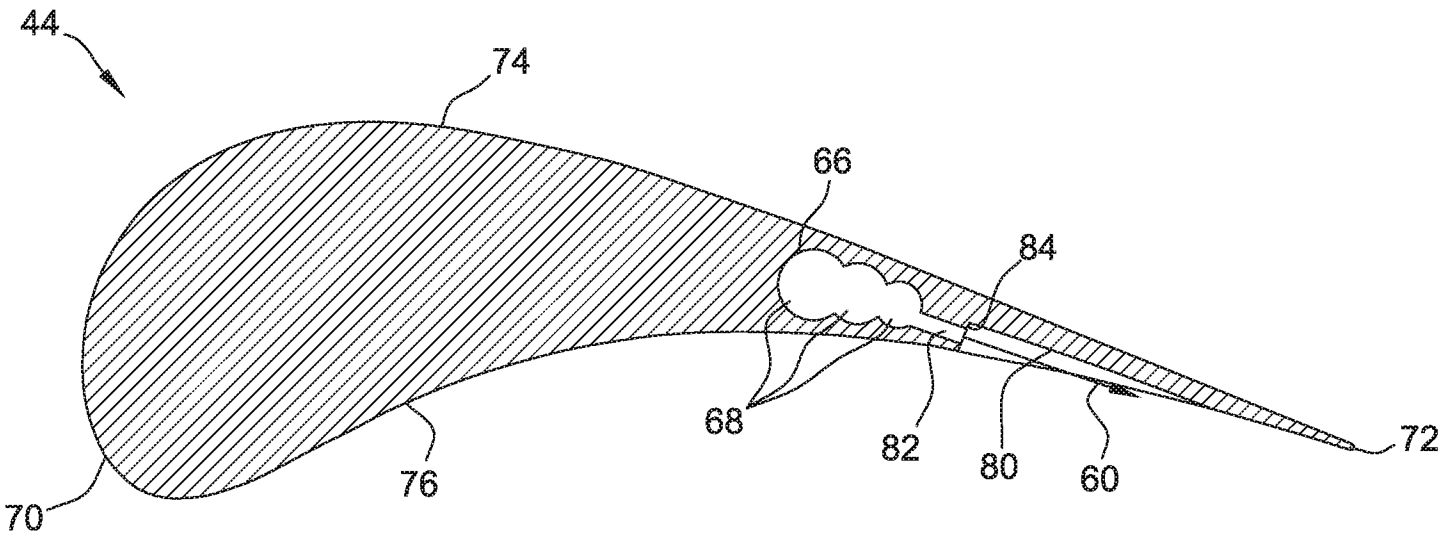
FIG. 6 is a schematic sectional view of the exemplary stationary blade shown in FIG. 4, taken along lines 6-6 shown in FIG. 5.

FIG. 4 is a schematic perspective view of an exemplary embodiment of one of the plurality of stationary single blades 44 shown in FIG. 2. FIG. 5 is another schematic perspective view of a portion of the exemplary stationary single blade 44 shown in FIG. 4. FIG. 6 is a schematic sectional view of stationary single blade 44 taken along lines 6-6 shown in FIG. 5.

With reference to FIGS. 4-6, in the exemplary embodiment, each stationary blade 44 extends from a leading edge 70 to a trailing edge 72. Moreover, each stationary blade 44 includes a suction side 74 and an opposite pressure side 76 that each extend between leading edge 70 and trailing edge 72. In the exemplary embodiment, stationary blade 44 includes a block 54 proximate first end 50 and configured for coupling to outer ring 46. In alternative embodiments, stationary blade 44 is coupleable to outer ring 46 in any suitable fashion. Further in the exemplary embodiment, each stationary single blade 44 includes inner platform 55 proximate second end 52 and configured for coupling against inner platform 55 of adjacent stationary single blades 44, as discussed above. In alternative embodiments, each stationary single blade 44 includes any suitable structure proximate second end 52.

Stationary blade 44 includes at least one blade inlet aperture 64 defined in flow communication with outer ring inlet aperture 62 (shown in FIG. 2), such as via a suitable distribution passage 63 defined in outer ring 46. In the exemplary embodiment, blade inlet aperture 64 extends through block 54. In alternative embodiments, blade inlet aperture 64 extends into stationary blade 44 in any suitable fashion.

Blade inlet aperture 64 is further coupled in flow communication with a blade supply passage 66 defined in stationary blade 44. Thus, stationary blade inlet aperture 64 is configured to channel ejection steam 60 from outer ring 46 to blade supply passage 66. In the exemplary embodiment, blade supply passage 66 extends generally radially within stationary blade 44. In alternative embodiments, blade supply passage 66 extends in any suitable fashion within stationary blade 44. In the exemplary embodiment, blade supply passage 66 is formed as a plurality of overlapping cylindrical openings 68 in stationary blade 44. In certain embodiments, forming blade supply passage 66 using overlapping cylindrical openings 68 enables a use of inexpensive and precise machining techniques to define blade supply passage 66 having a selected cross-sectional flow area. In alternative embodiments, blade supply passage 66 is formed in any suitable fashion.

A plurality of ejection channels 82 are defined in stationary blade 44 in flow communication with blade supply passage 66. Each ejection channel 82 extends through an outer surface of pressure side 76 of stationary blade 44. Thus, ejection channels 82 are configured to channel ejection steam 60 from blade supply passage 66 into primary flow path 32 proximate pressure side 76. In some embodiments, because the temperature of ejection steam 60 is higher than the temperature of working steam 40, ejection steam 60 tends to evaporate fine water droplets in primary flow path 32 adjacent pressure side 76. In some such embodiments, the evaporation of the fine water droplets reduces a deposition of water film on pressure side 76, which in turn reduces a release of coarse water droplets from trailing edge 72, thereby reducing erosion caused by impingement of such droplets on downstream rotor blades 38 (shown in FIG. 1).

Each ejection channel 82 is oriented such that ejection steam 60 is ejected along pressure side 76 in a direction generally towards trailing edge 72. More specifically, in the exemplary embodiment, each ejection channel 82 extends generally transverse to the radial direction and extends along pressure side 76 within stationary blade 44, such that ejection steam 60 is ejected towards trailing edge 72 generally parallel to pressure side 76 proximate trailing edge 72. In certain embodiments, ejection of ejection steam 60 towards trailing edge 72, along pressure side 76 proximate trailing edge 72, energizes fine water droplets in primary flow path 32 adjacent pressure side 76 in a direction that reduces a deposition of water film on pressure side 76, which in turn reduces a release of coarse water droplets from trailing edge 72, thereby reducing erosion caused by impingement of such droplets on downstream rotor blades 38. Moreover, in some embodiments, ejection of ejection steam 60 towards trailing edge 72 along pressure side 76 limits an alteration of a flow direction of working steam 40 in primary flow path 32. In alternative embodiments, each ejection channel 82 is oriented in any suitable fashion within stationary blade 44.

In the exemplary embodiment, a recess 80 is defined in pressure side 76 proximate trailing edge 72. More specifically, recess 80 is at least partially defined by a wall 84 that extends obliquely to pressure side 76, such that wall 84 at least partially faces trailing edge 72, and each ejection channel 82 extends through wall 84. For example, but not by way of limitation, wall 84 defines a plane approximately normal to pressure side 76. In some embodiments, ejection channels 82 oriented along pressure side 76 within stationary blade 44 eject steam 60 through wall 84 in a direction generally parallel to pressure side 76 proximate trailing edge 72. In alternative embodiments, stationary blade 44 does not include recess 80, and each ejection channel 82 extends through pressure side 76 oriented towards trailing edge 72 in any suitable fashion.

In certain embodiments, the plurality of ejection channels 82 is distributed radially along a part-span portion of stationary blade 44 proximate first end 50. In this context, the term "proximate" first end 50 indicates that a radially outermost ejection channel 82 is spaced a short distance from outer ring 46, such as at any radial location along airfoil 45 that is within one-tenth of span 48 from first end 50. As one example, in some such embodiments, the radially outermost ejection channel 82 is directly adjacent outer ring 46.

For example, in some embodiments, the plurality of ejection channels 82 is distributed from proximate radially outer first end 50 to about one-half of span 48 from first end 50. In some such embodiments, distribution of ejection channels 82 within the radially outer half-span portion of stationary blade 44 facilitates significantly reducing erosion as described above, and also facilitates reducing a cost and difficulty of manufacture of stationary blades 44 as compared to distributing the plurality of ejection channels 82 along a greater proportion of span 48.

For another example, in the exemplary embodiment, the plurality of ejection channels 82 is distributed from proximate radially outer first end 50 to about one-third of span 48 from first end 50. In the exemplary embodiment, distribution of ejection channels 82 within the radially outer one-third-span portion of stationary blade 44 provides a particularly beneficial combination of significant reduction of downstream erosion plus reduced cost and difficulty of manufacture.

In alternative embodiments, the plurality of ejection channels 82 is distributed radially along any suitable part-span or full-span portion of stationary blade 44.

In some embodiments, single stationary blade 44 is initially formed without blade inlet aperture 64, blade supply passage 66, and ejection channels 82, and subsequently blade inlet aperture 64, blade supply passage 66, and ejection channels 82 are added in a machining process. In alternative embodiments, each single stationary blade 44 of vane carrier 19 is formed in any suitable fashion that enables stationary blade 44 to function as described herein.

In the exemplary embodiment, each stationary blade 44 of each set 18 of stationary blades includes blade inlet aperture 64, blade supply passage 66, and at least one ejection channel 82. In alternative embodiments, at least one stationary blade 44 of at least one set 18 of stationary blades of steam turbine 10 does not include blade inlet aperture 64, blade supply passage 66, and ejection channels 82.

Figure 7:
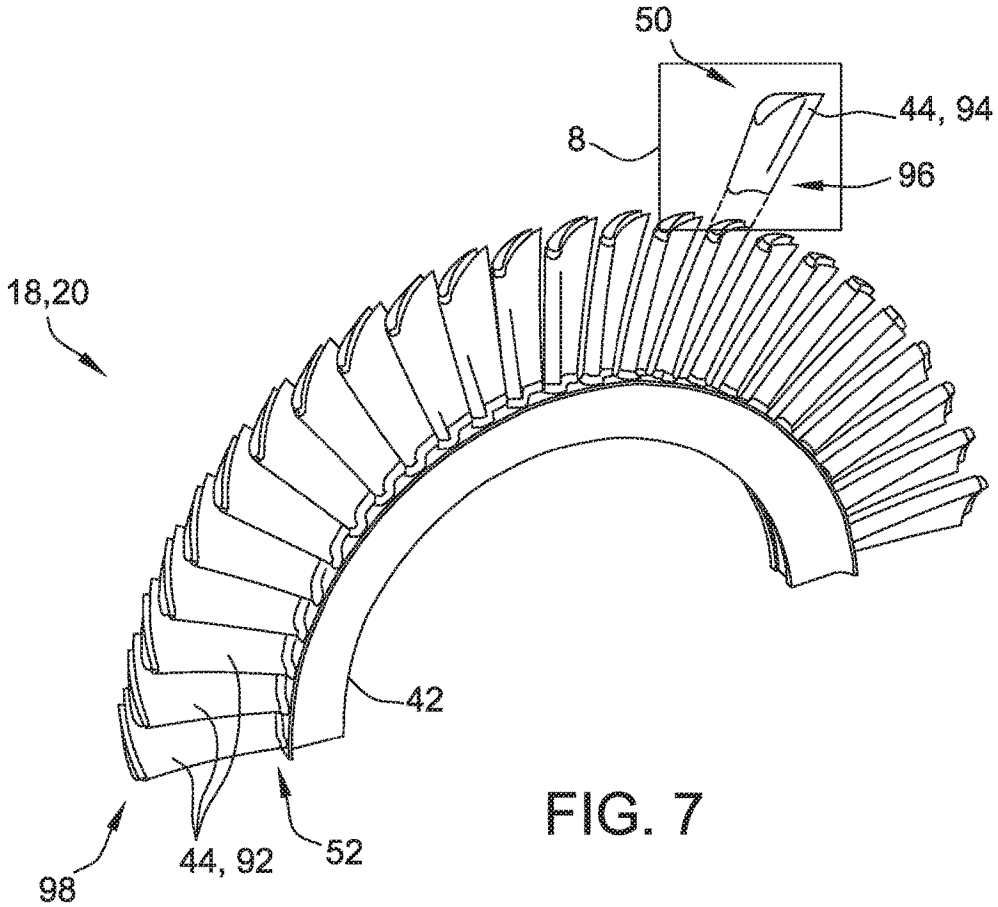
FIG. 7 is a schematic perspective view of a partially assembled diaphragm, such as the exemplary diaphragm shown in FIG. 2, according to an exemplary embodiment.
Figure 8:
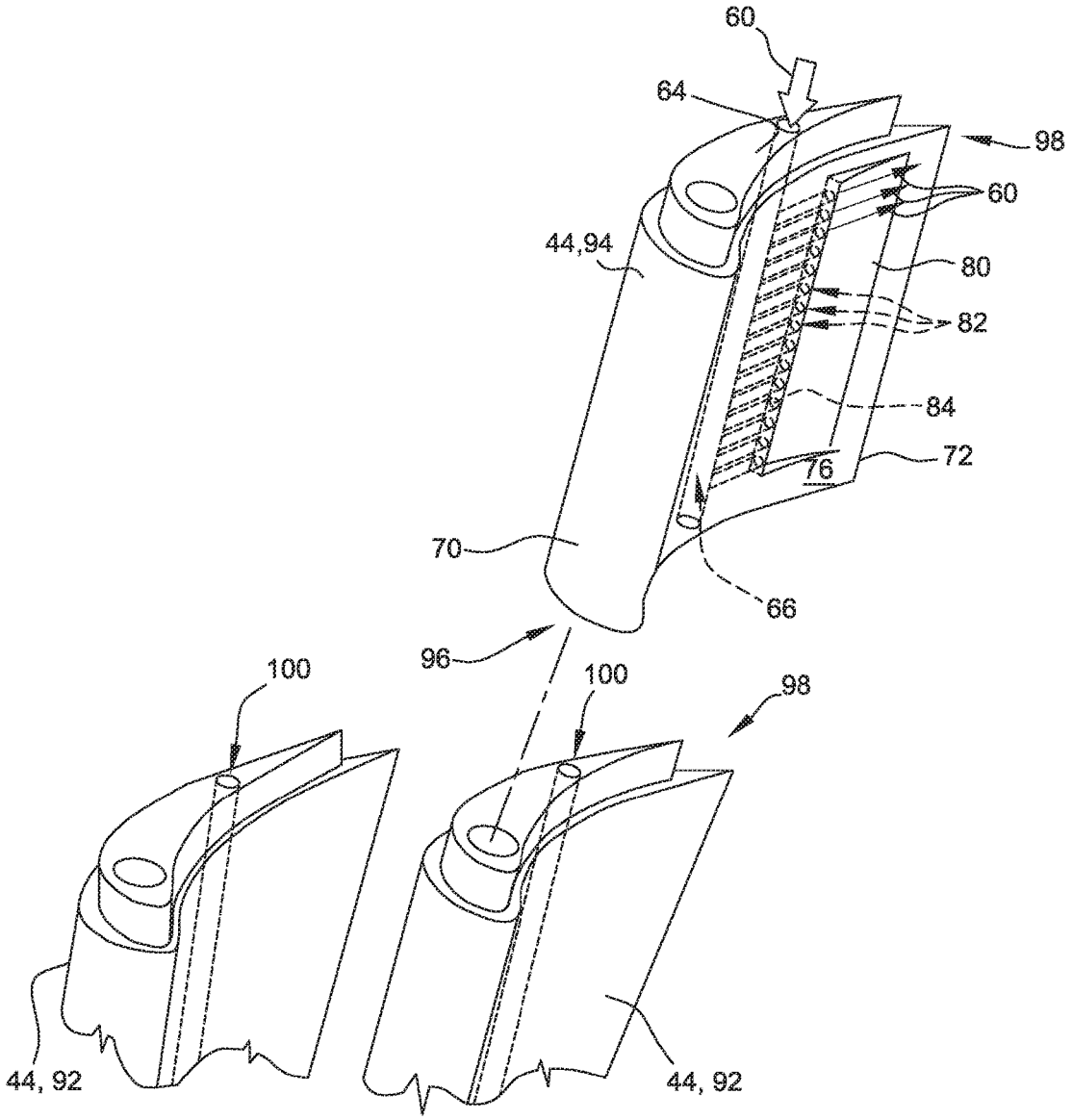
FIG. 8 is a detail view of a region 8 shown in FIG. 7.

FIG. 7 is a schematic perspective view of an exemplary embodiment of a partially assembled diaphragm 20, such as the exemplary diaphragm 20 shown in FIG. 3. FIG. 8 is a detail view of a region 8 shown in FIG. 7. With reference to FIGS. 7 and 8, in the exemplary embodiment of the set 18 of stationary blades embodied as diaphragm 20, each stationary blade 44 is formed from a radially inner portion 92 and a radially outer portion 94. More specifically, outer portion 94 extends radially inward from first end 50 to a first intermediate end 96, and inner portion 92 extends radially outward from second end 52 to a second intermediate end 98. Second intermediate end 98 of each inner portion 92 is configured for coupling to first intermediate end 96 of a respective outer portion 94 to form each stationary blade 44. For example, in some embodiments, each second intermediate end 98 is welded to the respective first intermediate end 96. In alternative embodiments, each second intermediate end 98 is coupled to the respective first intermediate end 96 in any suitable fashion.

In the exemplary embodiment, as described above for single stationary blades 44 of vane carrier 19, (shown in FIGS. 4-6), each stationary blade 44 of diaphragm 20 extends from leading edge 70 to trailing edge 72, and includes suction side 74 and opposite pressure side 76 that each extend between leading edge 70 and trailing edge 72. It should be understood, however, that airfoil portion 45 of stationary blade 44 of diaphragm 20 may have a different shape from airfoil portion 45 of stationary blade 44 of vane carrier 19.

Further in the exemplary embodiment, outer portion 94 of each stationary blade 44 includes at least one blade inlet aperture 64 defined in flow communication with outer ring inlet aperture 62 (shown in FIG. 3), such as via a suitable distribution passage (not shown) defined in outer ring 46. Also as described above for single stationary blades 44, outer portion 94 of each stationary blade 44 of diaphragm 20 includes blade supply passage 66 defined in stationary blade 44 and coupled in flow communication with blade inlet aperture 64, and plurality of ejection channels 82 defined in stationary blade 44 in flow communication with blade supply passage 66 and each extending through an outer surface of pressure side 76 of stationary blade 44. Ejection channels 82 are configured to channel ejection steam 60 from blade supply passage 66 into primary flow path 32 proximate pressure side 76, thereby evaporating fine water droplets and reducing erosion on downstream rotor blades 38 (shown in FIG. 1) in the same fashion as described above. Moreover, in the exemplary embodiment, each ejection channel 82 is again oriented such that ejection steam 60 is ejected along pressure side 76 in a direction generally towards trailing edge 72. In alternative embodiments, each ejection channel 82 is oriented in any suitable fashion within stationary blade 44.

Additionally in the exemplary embodiment, each ejection channel 82 extends generally transverse to the radial direction and extends along pressure side 76 within stationary blade 44, such that ejection steam 60 is ejected towards trailing edge 72 generally parallel to pressure side 76 proximate trailing edge 72, energizing fine water droplets in primary flow path 32 adjacent pressure side 76 in a direction that reduces a deposition of water film on pressure side 76 and/or limiting an alteration of a flow direction of working steam 40 in primary flow path 32, in the same fashion as described above. Further in the exemplary embodiment, stationary blade 44 includes recess 80 and wall 84 as described above, and ejection channels 82 oriented along pressure side 76 within stationary blade 44 again eject steam 60 through wall 84 in a direction generally parallel to pressure side 76 proximate trailing edge 72. In alternative embodiments, stationary blade 44 does not include recess 80, and each ejection channel 82 extends through pressure side 76 oriented towards trailing edge 72 in any suitable fashion.

In the exemplary embodiment, each stationary blade 44 of each set 18 of stationary blades includes blade inlet aperture 64, blade supply passage 66, and at least one ejection channel 82. In alternative embodiments, at least one stationary blade 44 of at least one set 18 of stationary blades of steam turbine 10 does not include blade inlet aperture 64, blade supply passage 66, and ejection channels 82.

In certain embodiments, the plurality of ejection channels 82 is again distributed radially along a part-span portion of stationary blade 44 proximate first end 50, as described above. For example, in some embodiments, outer portion 94 extends radially inward from first end 50 to about one-half of span 48 of stationary diaphragm blade 44, and inner portion 92 extends radially outward from second end 52 over the remaining portion of span 48 (shown in FIG. 3), which again facilitates significantly reducing erosion and a cost and difficulty of manufacture of stationary blades 44, as described above. For another example, in the exemplary embodiment, outer portion 94 extends radially inward from first end 50 to about one-third of span 48 of stationary blade 44, and inner portion 92 extends radially outward from second end 52 over the remaining portion of span 48, which again provides a particularly beneficial combination of significant reduction of downstream erosion plus reduced cost and difficulty of manufacture. In alternative embodiments, each of outer portion 94 and inner portion 92 extends over any suitable portion of span 48.

In certain embodiments, a circumferential section of inner ring 42 and the corresponding inner portions 92 of plurality of stationary diaphragm blades 44 extending radially outward therefrom are formed together unitarily, such as by a unitary casting. For example, in the embodiment illustrated in FIGS. 7 and 8, the circumferential section is a half-section of diaphragm 20. In the exemplary embodiment, the completed circumferential sections of diaphragm 20, each including the corresponding inner portions 92 extending therefrom, are coupled together in any suitable fashion. In some embodiments, formation of diaphragm 20 from inner ring 42 and inner portions 92 unitarily formed together, and subsequent coupling thereto of separately formed outer portions 94, enables relatively inexpensive formation of inner ring 42 and inner portions 92, and limits potentially more time- and cost-intensive manufacturing techniques needed to form blade supply passage 66 and ejection channels 82 to being performed separately on relatively small components such as outer portions 94. In alternative embodiments, at least one section of inner ring 42 is not formed unitarily together with the corresponding inner portions 92 extending therefrom.

In certain embodiments, a circumferential section of outer ring 46 (shown in FIG. 3) is positioned with respect to the circumferential section of inner ring 42, including inner portions 92 of stationary diaphragm blades 44 extending therefrom, prior to coupling first and second intermediate ends 96 and 98. Moreover, in some such embodiments, first end 50 of each outer portion 94 is coupled to outer ring 46 prior to coupling first intermediate end 96 of the outer portion 94 to second intermediate end 98 of the respective inner portion 92. Alternatively, first end 50 of each outer portion 94 is coupled to outer ring 46 concurrently or subsequently to coupling first intermediate end 96 of the outer portion 94 to second intermediate end 98 of the respective inner portion 92.

In the exemplary embodiment, each inner portion 92 is formed with a drain passage 100 extending therethrough. Drain passage 100 extends generally radially within inner portion 92, and is configured to couple in flow communication with blade supply passage 66 of the corresponding outer portion 94 when first and second intermediate ends 96 and 98 are coupled together. In some embodiments, drain passage 100 facilitates preventing an overpressure condition in blade supply passage 66 and ejection channels 82. Drain passage 100 opens to any suitable location (not shown) in stationary blade 44 and/or inner ring 42. In alternative embodiments, at least one inner portion 92 does not include drain passage 100.

Figure 9:
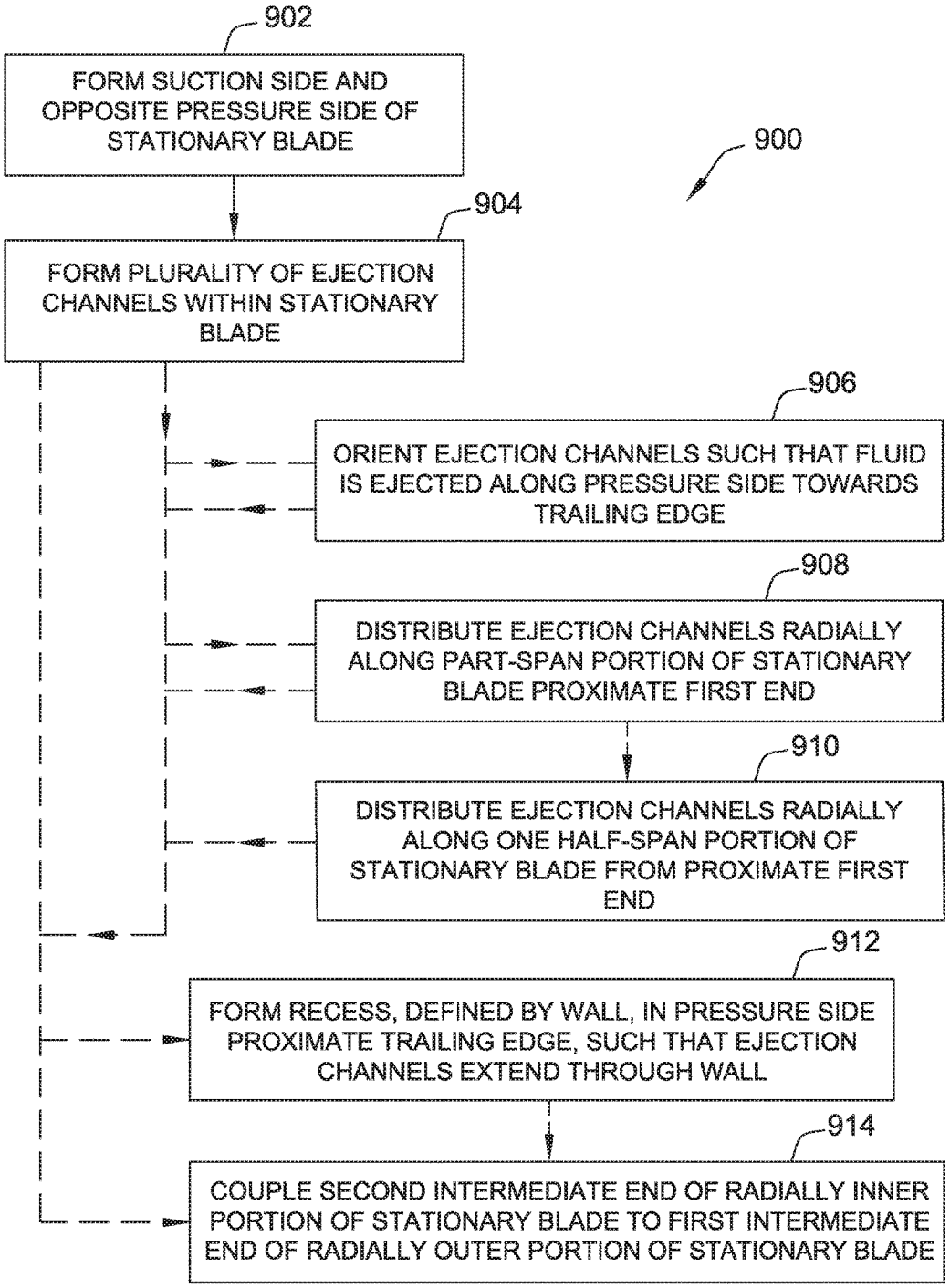
FIG. 9 is a flow diagram of an exemplary embodiment of a method of making a set of stationary blades, such as the exemplary set of stationary single blades coupled to the vane carrier shown in FIG. 2 or the exemplary diaphragm shown in FIG. 3, for a steam turbine, such as the exemplary steam turbine shown in FIG. 1.

FIG. 9 is a flow diagram of an exemplary embodiment of a method 900 of making a set of stationary blades, such as the exemplary set of stationary single blades 44 coupled to vane carrier 19 (shown in FIG. 2) or the exemplary diaphragm 20 (shown in FIG. 3), for a steam turbine, such as steam turbine 10. The set of stationary blades is coupled to an outer ring, such as outer ring 46 shown in FIG. 2 or outer ring 46 shown in FIG. 3, and extends radially inward therefrom. With reference to FIGS. 1-9, in the exemplary embodiment, method 900 includes forming 902 a suction side, such as suction side 74, and an opposite pressure side, such as pressure side 76, of at least one of the stationary blades. Method 900 also includes forming 904 a plurality of ejection channels, such as ejection channels 82, within the at least one stationary blade. Each of the ejection channels extends through an outer surface of the pressure side, and each of the ejection channels is coupled in flow communication to a blade inlet aperture of the at least one stationary blade, such as blade inlet aperture 64.

In some embodiments, the step of forming 904 the plurality of ejection channels includes orienting 906 each of the ejection channels such that an ejection fluid, such as ejection fluid 60, is ejected from each ejection channel along the pressure side towards a trailing edge of the at least one stationary blade, such as trailing edge 72.

In certain embodiments, the at least one stationary blade extends radially from a first end, such as first end 50, to a second end, such as second end 52, and defines a span therebetween, such as span 48, and the step of forming 904 the plurality of ejection channels includes distributing 908 the plurality of ejection channels radially along a part-span portion of the diaphragm blade proximate the first end. In some such embodiments, the step of distributing 908 the plurality of ejection channels includes distributing 910 the plurality of ejection channels radially along about a one-half-span portion of the diaphragm blade from proximate the first end.

In some embodiments, method 900 further includes forming 912 a recess, such as recess 80, in the pressure side proximate a trailing edge of the diaphragm blade, such as trailing edge 72. The recess is at least partially defined by a wall, such as wall 84, that extends obliquely to the pressure side, such that the wall at least partially faces the trailing edge, and such that each ejection channel extends through the wall.

In certain embodiments, the at least one stationary blade extends radially from a first end, such as first end 50, to a second end, such as second end 52; the at least one stationary blade includes a radially outer portion, such as outer portion 94, that extends radially inward from the first end to a first intermediate end, such as first intermediate end 96, and a radially inner portion, such as inner portion 92, that extends radially outward from the second end to a second intermediate end, such as second intermediate end 98; the plurality of ejection channels is defined solely in the radially outer portion; and method 900 further includes coupling 914 the second intermediate end to the first intermediate end. In some such embodiments, the inner portion is unitarily formed together with a circumferential section of an inner ring, such as inner ring 42, and subsequently coupled to the separately formed outer portion, as described above.

Exemplary embodiments of a set of stationary blades for a steam turbine, and method of making the set of stationary blades, are described above in detail. The embodiments provide advantages over known sets of stationary blades in that at least one stationary blade includes a plurality of ejection channels configured to eject a fluid at a temperature higher than a temperature of working steam proximate the set of stationary blades. Specifically, the higher temperature of the ejected fluid tends to evaporate water droplets in the working steam proximate the outer surface of the stationary blade, thereby reducing a deposition of water film on the stationary blade, which in turn reduces a release of coarse water droplets from a trailing edge of the stationary blade, thereby reducing erosion caused by impingement of such droplets on downstream rotor blades. Also specifically, in some embodiments, the ejection channels are oriented to eject the fluid along a pressure side of the stationary blade towards the trailing edge, which tends to energize any remaining droplets in the working steam in a direction that further reduces deposition of water film on the stationary blade and, thus, further reduces downstream erosion. Also specifically, in certain embodiments in which the set of stationary blades is embodied as a diaphragm, a circumferential section of an inner ring of the diaphragm and corresponding inner portions of the stationary blades extending radially outward therefrom are formed together unitarily, and outer portions of the stationary blades, which include the ejection channels, are formed separately and coupled to the inner portions, thereby limiting potentially more time- and cost-intensive manufacturing techniques needed to form the ejection channels to being performed on the separately formed outer portions.

The sets of stationary blades and methods described above are not limited to the specific embodiments described herein, but rather, components of the apparatus and/or steps of the methods may be utilized independently and separately from other components and/or steps described herein. For example, the exemplary embodiments can be implemented and utilized in connection with many other embodiments of steam turbines.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A set of stationary blades for a steam turbine, wherein at least one of said stationary blades comprises:

a suction side and an opposite pressure side;

a plurality of ejection channels defined in said at least one stationary blade, each of said plurality of ejection channels extends through an outer surface of said pressure side, each of said plurality of ejection channels is in flow communication with a blade inlet aperture;

wherein said at least one stationary blade extends radially from a first end to a second end defining a span therebetween, and further comprises:

a radially outer portion that extends radially inward from said first end to a first intermediate end; and a radially inner portion that extends radially outward from said second end to a second intermediate end, said second intermediate end coupled to said first intermediate end, wherein said plurality of ejection channels is defined solely in said radially outer portion.

2. The set of stationary blades of claim 1, wherein each of said ejection channels of said at least one stationary blade is oriented such that an ejection fluid is ejected from each said ejection channel along said pressure side towards a trailing edge of said at least one stationary blade.

3. The set of stationary blades of claim 1, wherein each of said plurality of ejection channels is distributed radially along a part-span portion of said at least one stationary blade proximate said first end.

4. The set of stationary blades of claim 3, wherein said plurality of ejection channels is distributed radially along about a one-half-span portion of said at least one stationary diaphragm blade from proximate said first end.

5. The set of stationary blades of claim 1, wherein said at least one stationary blade further comprises a recess defined in said pressure side proximate a trailing edge of said at least one stationary blade, said recess is at least partially defined by a wall that extends obliquely to said pressure side, such that said wall at least partially faces said trailing edge, and wherein each said ejection channel extends through said wall.

6. The set of stationary blades of claim 1, wherein said at least one stationary blade further comprises a blade supply passage defined therein, said blade supply passage extends radially within said at least one stationary blade and is in flow communication with said blade inlet aperture and said plurality of ejection channels.

7. A steam turbine comprising:

a casing comprising a supply passage defined therein, said supply passage configured to receive an ejection fluid;

an outer ring coupled to said casing, said outer ring comprising at least one outer ring inlet aperture defined therein and in flow communication with said supply passage;

a set of stationary blades coupled to said outer ring and extending radially inward therefrom, wherein at least one of said stationary blades comprises:

a suction side and an opposite pressure side;

a plurality of ejection channels defined in said at least one stationary blade, each of said plurality of ejection channels extends through an outer surface of said pressure side, each of said plurality of ejection channels coupled in flow communication to said at least one outer ring inlet aperture; and wherein said at least one stationary blade extends radially from a first end to a second end and defines a span therebetween, said at least one stationary blade further comprises:

a radially outer portion that extends radially inward from said first end to a first intermediate end; and a radially inner portion that extends radially outward from said second end to a second intermediate end, said second intermediate end coupled to said first intermediate end, wherein said plurality of ejection channels is defined solely in said radially outer portion.

8. The steam turbine of claim 7, wherein each of said ejection channels is oriented such that the ejection fluid is ejected from each said ejection channel along said pressure side towards a trailing edge of said at least one stationary blade.

9. The steam turbine of claim 7, wherein said plurality of ejection channels is distributed radially along a part-span portion of said at least one stationary blade proximate said first end.

10. The steam turbine of claim 9, wherein said plurality of ejection channels is distributed radially along about a one-third-span portion of said at least one stationary blade from proximate said first end.

11. The steam turbine of claim 7, wherein said at least one stationary blade further comprises a recess defined in said pressure side proximate a trailing edge of said at least one stationary blade, said recess is at least partially defined by a wall that extends obliquely to said pressure side, such that said wall at least partially faces said trailing edge, and wherein each said ejection channel extends through said wall.

12. The steam turbine of claim 7, wherein said steam turbine defines a primary flow path for working steam, said set of stationary blades is disposed in said primary flow path, said supply passage is configured to supply the ejection fluid at a temperature that is higher than a temperature of the working steam in said primary flow path proximate said set of stationary blades when said steam turbine is in operation.

13. A method of making a set of stationary blades for a steam turbine, the set of stationary blades coupled to an outer ring and extending radially inward therefrom, said method comprising:

forming a suction side and an opposite pressure side of at least one of the stationary blades;

forming a plurality of ejection channels within the at least one stationary blade, each of the ejection channels extends through an outer surface of the pressure side, each of the ejection channels coupled in flow communication to a blade inlet aperture of the at least one stationary blade; and wherein the at least one stationary blade extends radially from a first end to a second end and defines a span therebetween, and forming the plurality of ejection channels comprises distributing the plurality of ejection channels radially along a part-span portion of the diaphragm blade proximate the first end.

14. The method of claim 13, wherein forming the plurality of ejection channels comprises orienting each of the ejection channels such that an ejection fluid is ejected from each ejection channel along the pressure side towards a trailing edge of the at least one stationary blade.

15. The method of claim 13, wherein distributing the plurality of ejection channels comprises distributing the plurality of ejection channels radially along about a one-half-span portion of the diaphragm blade from proximate the first end.

16. The method of claim 13, further comprising forming a recess in the pressure side proximate a trailing edge of the at least one stationary blade, the recess at least partially defined by a wall that extends obliquely to the pressure side, such that the wall at least partially faces the trailing edge, and such that each ejection channel extends through the wall.

17. The method of claim 13, wherein the at least one stationary blade extends radially from a first end to a second end, wherein the stationary blade includes a radially outer portion that extends radially inward from the first end to a first intermediate end and a radially inner portion that extends radially outward from the second end to a second intermediate end, and wherein the plurality of ejection channels is defined solely in the radially outer portion, said method further comprises coupling the second intermediate end to the first intermediate end.

* * * * *